United States Patent [19]

Yoshio et al.

[11] Patent Number: 4,997,531

[45] Date of Patent: Mar. 5, 1991

[54] PROCESS FOR MANUFACTURING ELECTROLYTIC MANGANESE OXIDE

[75] Inventors: Masaki Yoshio, Sagashi; Ryoichi Shimizugawa, Ichikawashi, both of Japan

[73] Assignees: Japan Metels & Chemical Co. Inc., Tokyo, Japan; International Battery Material Association Inc., Brunswick, Ohio

[21] Appl. No.: 542,082

[22] Filed: Jun. 22, 1990

[51] Int. Cl.[5] ..... C25B 1/00; C25B 1/02; C25B 1/22

[52] U.S. Cl. ..... 204/96; 204/86; 204/93; 204/104; 204/129

[58] Field of Search ..... 204/93, 96, 104, 129, 204/86

[56] References Cited

U.S. PATENT DOCUMENTS

| | | | |
|---|---|---|---|
| Re. 31,286 | 6/1983 | Everett | 204/96 |
| 4,405,419 | 9/1983 | Misawa et al. | 204/96 |
| 4,818,354 | 4/1989 | Preisler et al. | 204/96 |
| 4,948,484 | 8/1990 | Anderson | 429/224 |

FOREIGN PATENT DOCUMENTS 60-138085 7/1985 Japan .

*Primary Examiner*—John F. Niebling
*Assistant Examiner*—David G. Ryser

[57] ABSTRACT

A process for producing electrolytic manganese dioxide comprising the step of suspending carbon fibers in a bath for producing manganese dioxide and electrolyizing said bath to produce electrolytic manganese dioxide.

7 Claims, No Drawings

PROCESS FOR MANUFACTURING ELECTROLYTIC MANGANESE OXIDE

FIELD OF THE INVENTION

The invention relates to a process for manufacturing electrolytic manganese dioxide by electrolyzing a bath containing carbon fibers suspended in the electrolyte of the bath. The electrolytic manganese dioxide produced has high conductivity and improved discharge capability when used in electrochemical cell applications.

BACKGROUND OF THE INVENTION

In prior art methods for producing electrolytic manganese dioxide, a manganese sulfate solution is electrolyzed with titanium, lead or graphite anodes. Recently, titanium electrodes have been used more frequently as the anode for the electrolytic processes. The reaction in a conventional electrolytic process is as follows:

$$MnSO_4+2H_2O+2e^- \rightarrow MnO_2+H_2\uparrow$$

Based on this reaction, when one mole of $MnO_2$ is produced, an equivalent amount of sulfuric acid is produced at the anode and hydrogen gas is produced at the cathode. When the electrolysis is made with a titanium electrode at a high current density, the manganese consumption at the anode is high and the supply of $MnSO_4$ is generally not sufficient. Therefore the solution at the anode surface becomes $H_2SO_4$ rich and passivation of the titanium electrode tends to take place. Under this condition, the upper limit of the current density with the titanium electrode is believed to be 0.8 to 1.0 amp/dm$^2$ When a higher current density is applied, a non-conductive passivation film is produced on the titanium electrode and the continuation of the electrolytic operation becomes difficult because of the sudden increase in the bath voltage. Under a high current density and high voltage condition, the electrolytic manganese dioxide not only tends to fall from the electrode (does not adhere to the electrode), but also tends to contain ↓ structure material, which is a material having poor discharge performance when used in electrochemical cell systems.

To overcome this difficulty, Japan Metals and Chemical Company developed a slurry method in which manganese dioxide is suspended in the electrolyte of the electrolytic bath. This method is disclosed in Japanese Patent 57-42711. A further improvement was made for the slurry method by using carbon powders such as carbon black or acetylene black suspended in the electrolytic bath. This method is disclosed in Japanese Patent 61-47911.

It is an object of the present invention to provide an improved method for yielding a superior electrolytic manganese dioxide having better conductivity and discharge capability when used in electrochemical cell applications.

SUMMARY OF THE INVENTION

The invention relates to a process in which carbon fibers are suspended in an electrolytic manganese dioxide bath and then electrolyzing said bath to produce superior battery grade electrolytic manganese dioxide. Suitable carbon fibers for the process include pitch, polyacrylonitrile (PAN), rayon or the like fibers having a preferred diameter of 0.2 to 20 microns, more preferably a diameter of 0.2 to 1 micron, and a length of at least 5 microns, more preferably a length of 10 to 200 microns. However, other carbon fibers may be used in the process of this invention.

The pitch and PAN carbon fibers are hydrophobic and therefore are not easily suspended in an aqueous electrolyte of an electrolytic bath. Therefore the carbon fibers which are preferred for this invention are treated with nitric acid or any suitable surface active agent to facilitate the suspension of the carbon fibers in the electrolytic bath. An alcohol can also be added to the bath to facilitate the suspension of the carbon fibers in the bath.

Carbon fibers have a different shape from acetylene black or carbon black. It is believed that since the shape of the carbon fibers is needle shaped, the shape improves the specific conductivity of the electrolytic manganese dioxide produced.

EXAMPLE

An electrolytic bath 5.5 m long, 1.3 m wide and 1.4 m deep, was used with vertically spaced 100 titanium positive anode electrodes (50 cm wide, 100 cm long and 4 mm thick) and 100 graphite cathodes. The electrolyte was $MnSO_4$ (1 mole/l) aqueous solution containing carbon fibers of 0.5 g/l to 10 g/l. The electrolysis was carried out at 1.0 amp/dm$^2$. In addition to carbon fibers, acetylene black and electrolytic manganese dioxide powder were also tested by suspending them in a bath. The results achieved are shown in the Table below.

TABLE

| | Electrolytic Conditions | | | Properties of EMD | |
|---|---|---|---|---|---|
| Experiment No. | Suspension Material | Concentration of Suspension Material (g/l) | Current density (A/dm$^2$) | Capacity of KOH (mAH/g) | Specific resistance (ohm-cm) |
| 1 | pitch fiber | 0.5 | 1.0 | 233 | 140 |
| 2 | pitch fiber | 1.0 | 1.0 | 240 | 115 |
| 3 | pitch fiber | 5.0 | 1.0 | 249 | 90 |
| 4 | pitch fiber | 10.0 | 1.0 | 255 | 46 |
| 5 | PAN fiber | 5.0 | 1.0 | 247 | 85 |
| 6 | none | — | 0.8 | 235 | 170 |
| 7 | EMD powder | 0.1 | 1.6 | 240 | 165 |
| 8 | Acetylene black | 5.0 | 1.6 | 231 | 159 |

Experiments 6, 7 and 8 were conducted as prior art comparison experiments to the invention which are covered by experiments 1 through 5.

In the experiments, the electrolytic manganese dioxide which was produced was washed, ground, neutralized and dried by a conventional procedure. The discharge test was carried out in a 44% KOH solution at 5MA/0.2g EMD at a constant current discharge. The cell voltage was measured vs. Hg/HgO reference electrode. The capacity in discharge time to the cut-off voltage of −400 mV. The resistance was measured in an ohm meter under 1000Kg/cm$^2$. From the data shown in the Table, the electrolytic manganese dioxide produced by the subject inventive process (Experiments 1 through 5) is better in conductivity and better in discharge capacity than the prior art electrolytic manganese dioxide produced (Experiments 6, 7 and 8). The data in the Table show that the electrolytic manganese dioxide produced in accordance with the invention is an improved battery grade electrolytic manganese dioxide having superior conductivity and discharge characteristics.

What is claimed:

1. A process for producing electrolytic manganese dioxide comprising the step of suspending carbon fibers in a bath capable of producing manganese dioxide and electrolyizing said bath to produce electrolytic manganese dioxide.

2. The process of claim 1 wherein the carbon fibers are pitch fibers.

3. The process of claim 1 wherein the carbon fibers are polyacrylonitrile fibers.

4. The process of claim 1 wherein the carbon fibers have a diameter of 0.2 to 20 microns and a length of at least 5 microns.

5. The process of claim 4 wherein the carbon fibers have a diameter of 0.2 micron to 1 micron and a length of 10 to 200 microns.

6. The process of claim 1 wherein the bath comprises a $MnSO_4$ aqueous solution.

7. The process of claim 1 wherein the bath contains a titanium electrode, a graphite electrode and an electrolyte solution containing $MnSO_4$.

* * * * *